US007084827B1

(12) United States Patent
Strange et al.

(10) Patent No.: US 7,084,827 B1
(45) Date of Patent: Aug. 1, 2006

(54) PHASED ARRAY ANTENNA WITH AN IMPEDANCE MATCHING LAYER AND ASSOCIATED METHODS

(75) Inventors: Roger W. Strange, Palm Bay, FL (US); Anthony M. Jones, Palm Bay, FL (US); Timothy E. Durham, Melbourne, FL (US); Randy E. Boozer, Melbourne, FL (US); Dieter L. Gum, Indialantic, FL (US)

(73) Assignee: Harris Corporation, Melbourne, FL (US)

( * ) Notice: Subject to any disclaimer, the term of this patent is extended or adjusted under 35 U.S.C. 154(b) by 39 days.

(21) Appl. No.: 11/052,579

(22) Filed: Feb. 7, 2005

(51) Int. Cl.
*H01Q 9/28* (2006.01)
*H01Q 9/16* (2006.01)

(52) U.S. Cl. ..... 343/795; 343/797; 343/822

(58) Field of Classification Search ..... 343/795, 343/797, 700 MS, 820, 821, 822
See application file for complete search history.

(56) References Cited

U.S. PATENT DOCUMENTS

| | | | | |
|---|---|---|---|---|
| 6,512,487 | B1 | 1/2003 | Taylor et al. | 343/795 |
| 6,806,843 | B1 | 10/2004 | Killen et al. | 343/795 |
| 6,822,616 | B1 * | 11/2004 | Durham et al. | 343/795 |
| 6,856,297 | B1 * | 2/2005 | Durham et al. | 343/795 |
| 6,876,336 | B1 * | 4/2005 | Croswell et al. | 343/795 |
| 6,958,738 | B1 * | 10/2005 | Durham et al. | 343/909 |

OTHER PUBLICATIONS

Munk, Frequency Selective Surfaces, Theory and Design, John Wiley & Sons, Inc., 2000.

* cited by examiner

*Primary Examiner*—Hoanganh Le
(74) *Attorney, Agent, or Firm*—Allen, Dyer, Doppelt, Milbrath & Gilchrist, P.A.

(57) ABSTRACT

An antenna includes a substrate, and an array of dipole antenna elements on the substrate. Each dipole antenna element includes a medial feed portion and a pair of legs extending outwardly therefrom. Adjacent legs of adjacent dipole antenna elements include respective spaced apart end portions with impedance coupling therebetween. An impedance matching layer is adjacent a side of the array of dipole antenna elements opposite the substrate. The impedance matching layer includes an array of spaced apart conductive elements.

42 Claims, 7 Drawing Sheets

PHASED ARRAY ANTENNA WITH AN IMPEDANCE MATCHING LAYER AND ASSOCIATED METHODS

FIELD OF THE INVENTION

The present invention relates to the field of communications, and more particularly, to a phased array antenna and related methods.

BACKGROUND OF THE INVENTION

Existing phased array antennas include a wide variety of configurations for various applications, including communication systems. Example communication systems include personal communication service (PCS) systems, satellite communication systems and aerospace communication systems, which require such characteristics as low cost, light weight, low profile, and a low sidelobe.

These desirable characteristics are provided in general by printed circuit antennas. The simplest forms of printed circuit antennas are microstrip antennas wherein flat conductive elements, such as dipole antenna elements, are spaced from a single essentially continuous ground plane by a dielectric sheet of uniform thickness.

In general, the radiation pattern of a phased array antenna is determined by specifying the antenna element currents in both magnitude and phase. The spacing between antenna elements in such an array is usually less than one-half wavelength, and inter-element coupling can limit performance. In particular, the antenna element currents together with this inter-element coupling produces an input impedance to each antenna element that may be different from the usual impedance of the individual antenna elements.

An example phased array antenna comprising an array of dipole antenna elements is disclosed in U.S. Pat. No. 6,512,487 to Taylor et al., which is incorporated herein by reference in its entirety and which is assigned to the current assignee of the present invention. The phased array antenna exhibits a wide bandwidth (about 9:1), but is matched only moderately well over much of the band. The impedance match with the individual dipole antenna elements tends to degrade as the bandwidth is increased. Since antenna gain is related to the quality of this impedance match, antenna performance is typically reduced as the impedance match degrades.

SUMMARY OF THE INVENTION

In view of the foregoing background, it is therefore an object of the present invention to improve impedance matching of a phased array antenna.

This and other objects, features, and advantages in accordance with the present invention are provided by an antenna comprising a substrate, and an array of dipole antenna elements on the substrate. Each dipole antenna element may comprises a medial feed portion and a pair of legs extending outwardly therefrom, and adjacent legs of adjacent dipole antenna elements include respective spaced apart end portions with impedance coupling therebetween. At least one impedance matching layer is adjacent a side of the array of dipole antenna elements opposite the substrate. The at least one impedance matching layer may comprise an array of spaced apart conductive elements.

The at least one impedance matching layer advantageously improves the impedance match of the individual dipole antenna elements over the bandwidth of the phased array antenna. This is primarily due to the near-field coupling of the at least one impedance matching layer with the dipole antenna elements, which augments the inter-element coupling of the phased array antenna. An improved impedance match lowers antenna VSWR, which in turn increases antenna gain.

The conductive elements of the impedance matching layer may be periodically spaced apart from one another. Each conductive element may comprise a conductive loop, and each conductive loop may have a hexagonal shape, for example. The at least one impedance matching layer may comprise a dielectric layer supporting the array of spaced apart conductive elements. In addition, the at least one impedance matching layer may comprise a plurality of impedance matching layers.

The capacitive coupling between the respective spaced apart end portions of adjacent legs of adjacent dipole antenna elements may be provided by predetermined shapes and relative positioning of the adjacent legs. In one embodiment, each leg may comprise an elongated body portion, and an enlarged width end portion connected to an end of the elongated body portion. In another embodiment, the spaced apart end portions in adjacent legs may comprise interdigitated portions. In yet another embodiment, a respective impedance element may be associated with the spaced apart end portions of adjacent legs of adjacent dipole antenna elements.

The antenna has a desired frequency range, and the spacing between the end portions of adjacent legs may be less than about one-half a wavelength of a highest desired frequency. The array of dipole antenna elements may comprise first and second sets of orthogonal dipole antenna elements to provide dual polarization.

The antenna may further comprise a ground plane adjacent a side of the substrate opposite the array of dipole antenna elements. The antenna has a desired frequency range, and the ground plane may be spaced from the array of dipole antenna elements less than about one-half a wavelength of a highest desired frequency. The array of dipole antenna elements may be sized and relatively positioned so that the antenna is operable over a frequency bandwidth of about 9:1. An example frequency range may be 2 to 18 GHz, for example. Each dipole antenna element may comprise a printed conductive layer.

Another aspect of the present invention is directed to a phased array antenna comprising a substrate, and an array of dipole antenna elements on the substrate. Each dipole antenna element may comprise a medial feed portion and a pair of legs extending outwardly therefrom, and adjacent legs of adjacent dipole antenna elements may include respective spaced apart end portions with capacitive coupling therebetween. At least one impedance matching layer may be adjacent a side of the array of dipole antenna elements opposite the substrate. The at least one impedance matching layer may comprise an array of spaced apart conductive loops. A controller may be connected to the array of dipole antenna elements.

Yet another aspect of the present invention is directed to a method for making an antenna as defined above.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime, double prime and triple prime notations are used to indicate similar elements in alternate embodiments.

Figure 1:
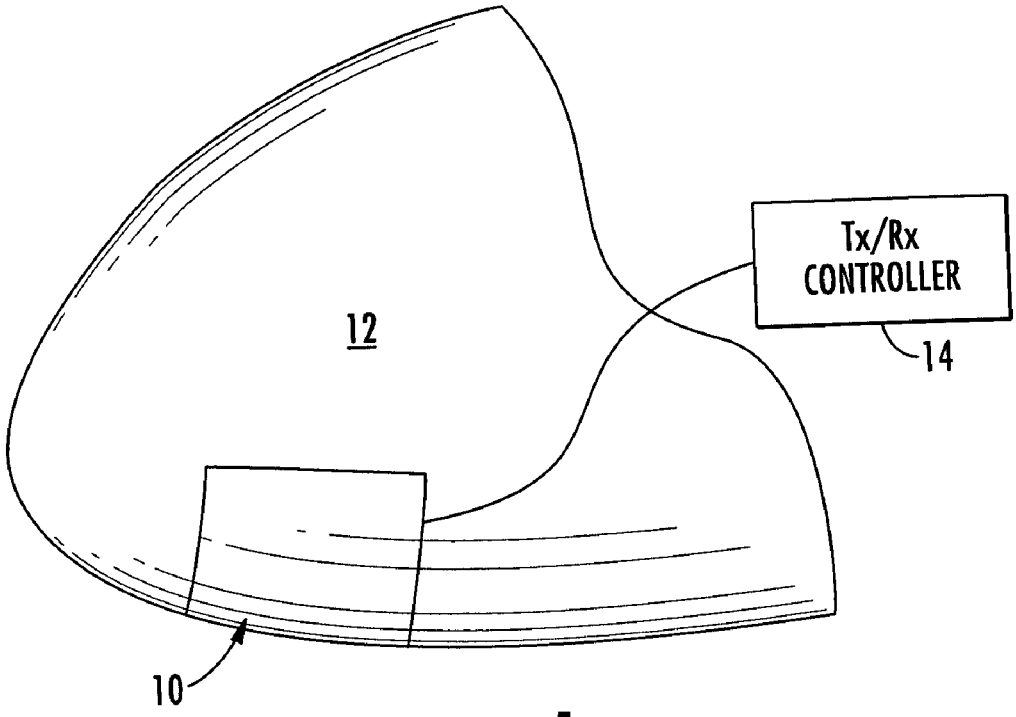
FIG. 1 is a schematic diagram illustrating a phased array antenna in accordance with the present invention mounted on the nosecone of an aircraft, for example.
Figure 2:
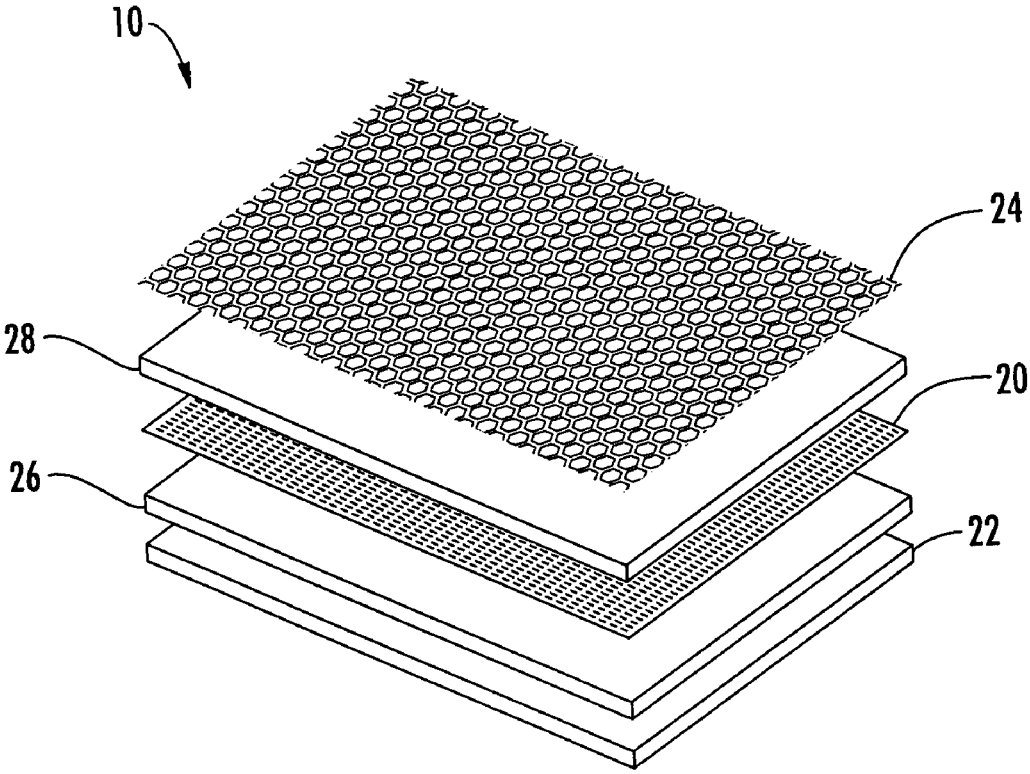
FIG. 2 is an exploded view of the phased array antenna of FIG. 1 including an impedance matching layer.

Referring initially to FIGS. 1 and 2, a phased array antenna 10 in accordance with the present invention will now be described. The antenna 10 may be mounted on the nosecone 12 or other rigid mounting member of an aircraft or spacecraft, for example. A transmission and reception controller 14 is connected to the antenna 10, as readily appreciated by those skilled in the art.

The phased array antenna 10 is preferably formed of a plurality of layers as shown in FIG. 2. These layers may be flexible, and include a dipole layer 20 or current sheet sandwiched between a ground plane 22 and at least one impedance matching layer 24. A dielectric layer 26 is between the ground plane 22 and the dipole layer 20, and a dielectric layer 28 is between the dipole layer and the impedance matching layer 24. Although not illustrated, respective adhesive layers secure the dipole layer 20, ground plane 22, impedance matching layer 24, and dielectric layers 26, 28 together to form the flexible and conformal antenna 10. Of course other ways of securing the layers may also be used.

The at least one impedance matching layer 24 advantageously improves the impedance match of the individual dipole antenna elements on the dipole layer 20 over the bandwidth of the antenna 10 without adding aperture area or active components. The inventors theorize that this is primarily due to the near-field coupling of the impedance matching layer 24 with the dipole antenna elements, which augments the inter-element coupling of the antenna 10. This results in an improved impedance match which lowers antenna VSWR, which in turn increases antenna gain. The inventors theorize without wishing to be bound thereto that this is why the impedance matching layer 24 improves the impedance match of the dipole antenna elements.

Figure 3:
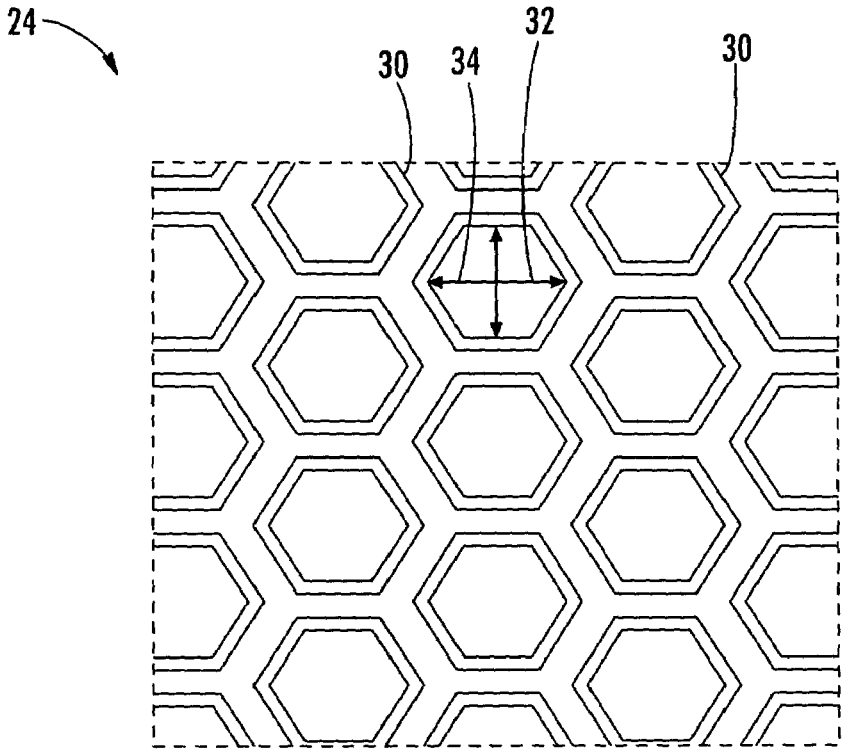
FIG. 3 is an enlarged view of a portion of the impedance matching layer as used in the phased array antenna of FIG. 2.

As illustrated in FIG. 3, the impedance matching layer 24 comprises an array of spaced apart conductive elements 30. The conductive elements 30 are preferably periodically spaced apart from one another, although they may be non-periodically spaced apart. Each conductive element 30 may comprise a conductive loop, and each conductive loop may have a hexagonal shape, for example. The conductive loop may have other shapes, including ovals, squares, triangles, pentagons, octagons, etc. These particular shapes are closed loops, although the conductive loops do not necessarily need to be closed, as readily appreciated by those skilled in the art. In addition, the conductive elements 30 are floating, i.e., they are not tied to ground.

The conductive elements 30 may have similar construction to a frequency selective surface (FSS). Reference is directed to U.S. Pat. No. 6,806,843 to Killen et al., which is incorporated herein by reference in its entirety and which is assigned to the current assignee of the present invention. The conductive elements 30 are sized to be resonant outside the desired operating frequency of the antenna 10.

The illustrated antenna 10 operates over 2 to 18 GHz, for example, which is a 9:1 bandwidth. Of course, an antenna in accordance with the present invention is not limited to this frequency band. In fact, an antenna with an impedance matching layer 24 may be scaled to operate over any other frequency band within the radio frequency spectrum. The following dimensions of the conductive elements 30 of the impedance matching layer are with respect to the 2 to 18 GHz frequency band. Each hexagonal shape has an x-dimension 32 within a range of 0.45 to 0.65 cm, and a y-dimension 34 within a range of 0.50 to 0.70 cm, for example. The corresponding perimeter of each hexagonal shape is within a range of about 1.7 to 2.10 cm. The line width of each conductive element 30 is typically 0.017 cm, and the gap between conductive elements 30 varies within a range of about 0.025 to 0.15 cm. Of course these numbers will vary depending on the actual frequency and intended application, as readily appreciated by those skilled in the art. The thickness of the matching layer 24 is within a range of about 5 to 10 mils.

The conductive elements 30 are supported by a dielectric layer 28, and may be formed by a conductive surface printed thereon. The dielectric layer 28 may have a thickness less than or equal to one-half the wavelength of the highest operating frequency of the antenna 10.

Figure 4:
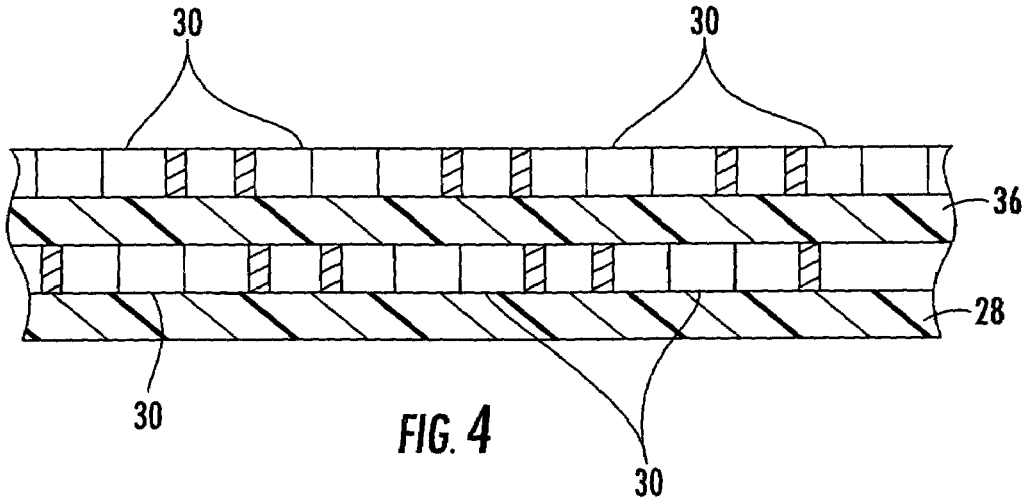
FIG. 4 is a cross-sectional view of a plurality of impedance matching layers in accordance with the present invention.

A low dielectric filler material may be between the conductive elements 30, and can be formed by air gaps, adhesive film or any other filling dielectric material. In addition, the impedance matching layer 24 may comprise a plurality of layers of conductive elements as illustrated in FIG. 4. Another dielectric layer 36 supports the second set of conductive elements 30. Although not illustrated, another dielectric layer may be positioned between and on the conductive elements 30 associated with the second impedance matching layer.

Figure 5:
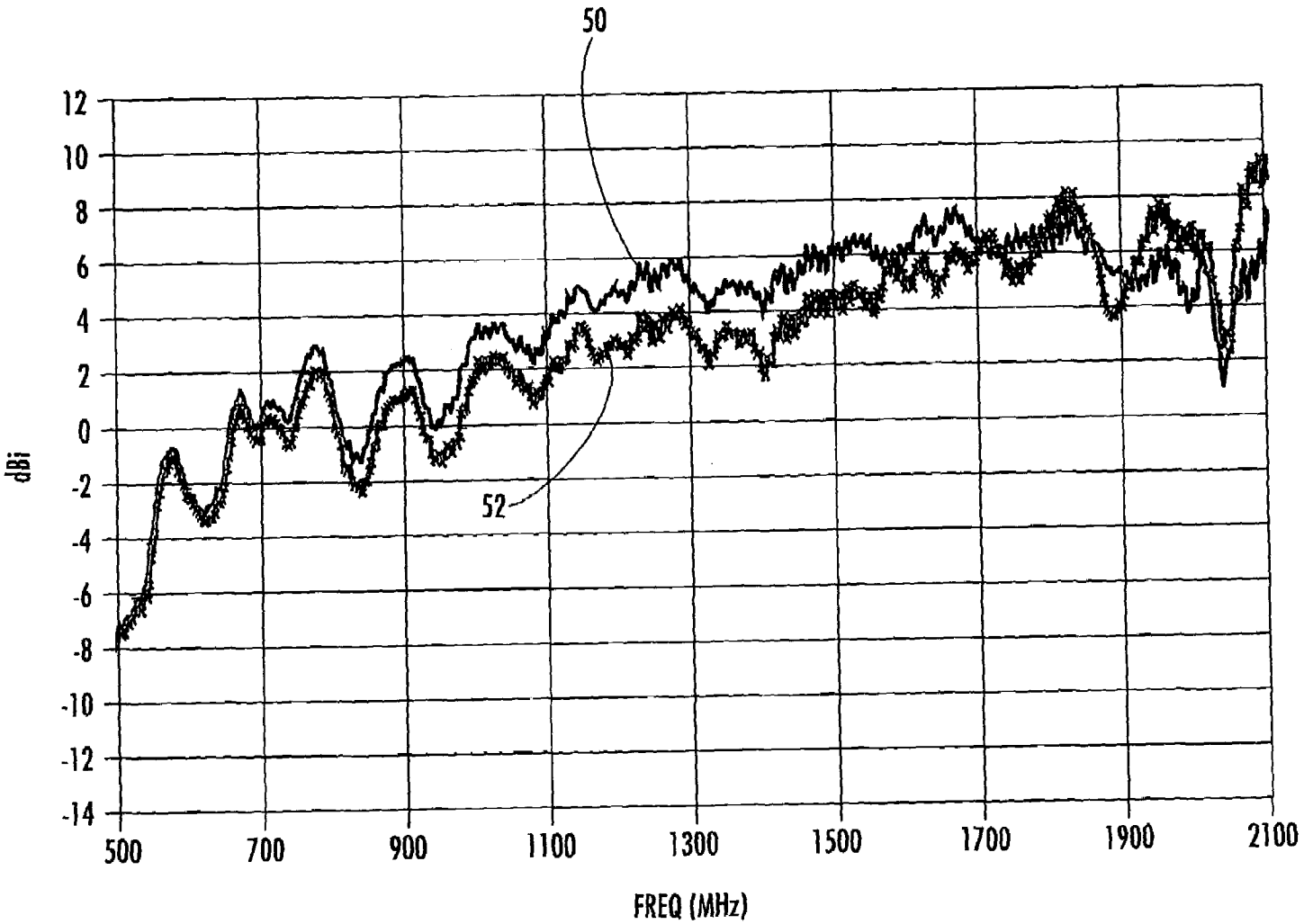
FIG. 5 is a plot of antenna gain versus frequency for the phased array antenna in accordance with the present invention.
Figure 6:
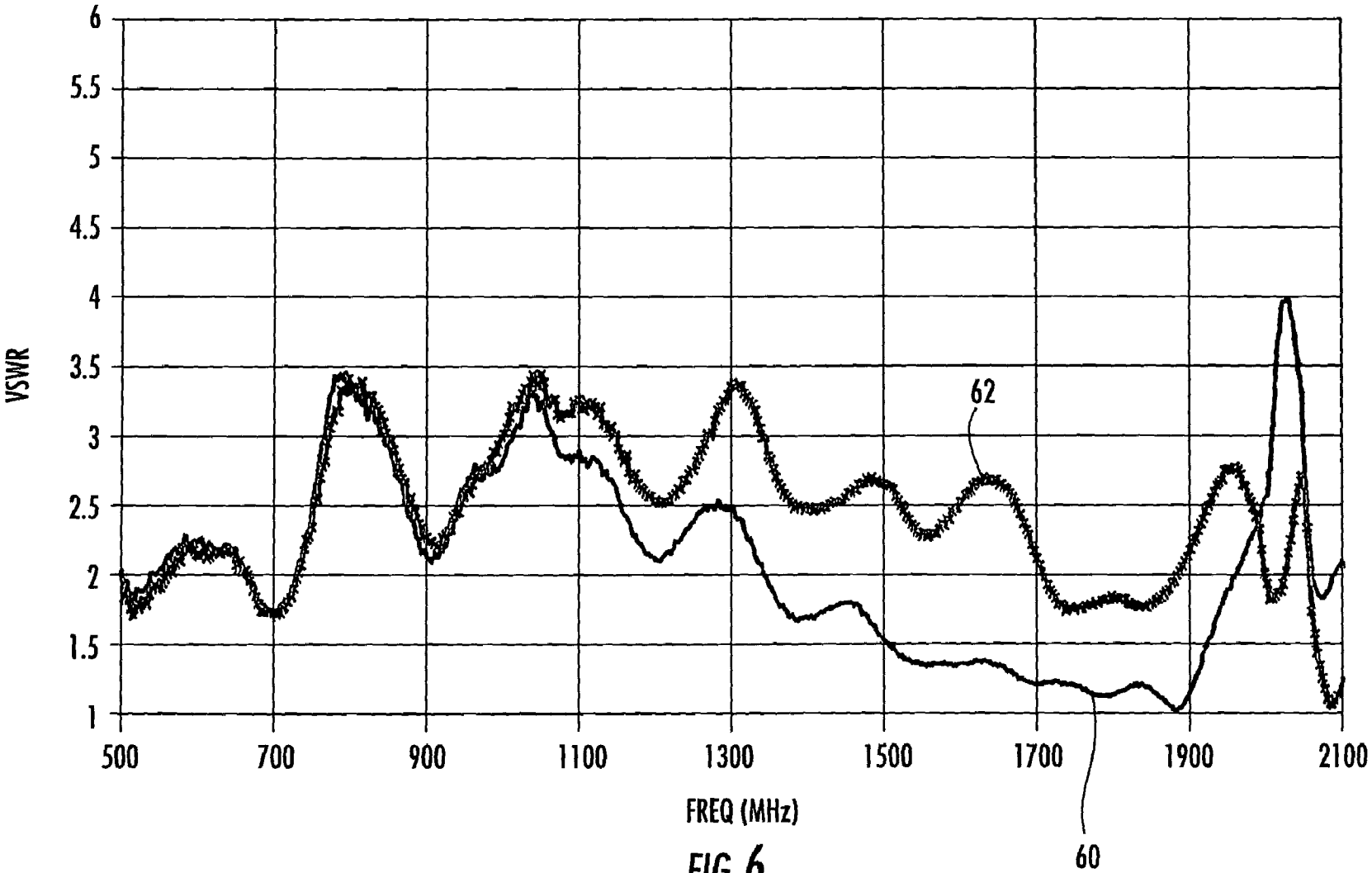
FIG. 6 is a plot of VSWR versus frequency for the phased array antenna in accordance with the present invention.

Antenna performance with and without the impedance matching layer 24 is illustrated in FIGS. 5 and 6. Line 50 in FIG. 5 represents measured antenna gain over a frequency range of 0.5 to 2.1 GHz with the impedance matching layer 24. Line 52 represents measured antenna gain over the same frequency range without the impedance matching layer 24. The gain of the antenna 10 is increased by about 0.5 to 1.8 dBi with the impedance matching layer 24.

Line 60 in FIG. 6 represents measured VSWR over the frequency range of 0.5 to 2.1 GHz with the impedance matching layer 24. Line 62 represents antenna VSWR over the same frequency range without the impedance matching layer 24. The VSWR of the antenna 10 is reduced from about 2.5:1 to about 1.5:1 with the impedance matching layer 24.

Figure 7:
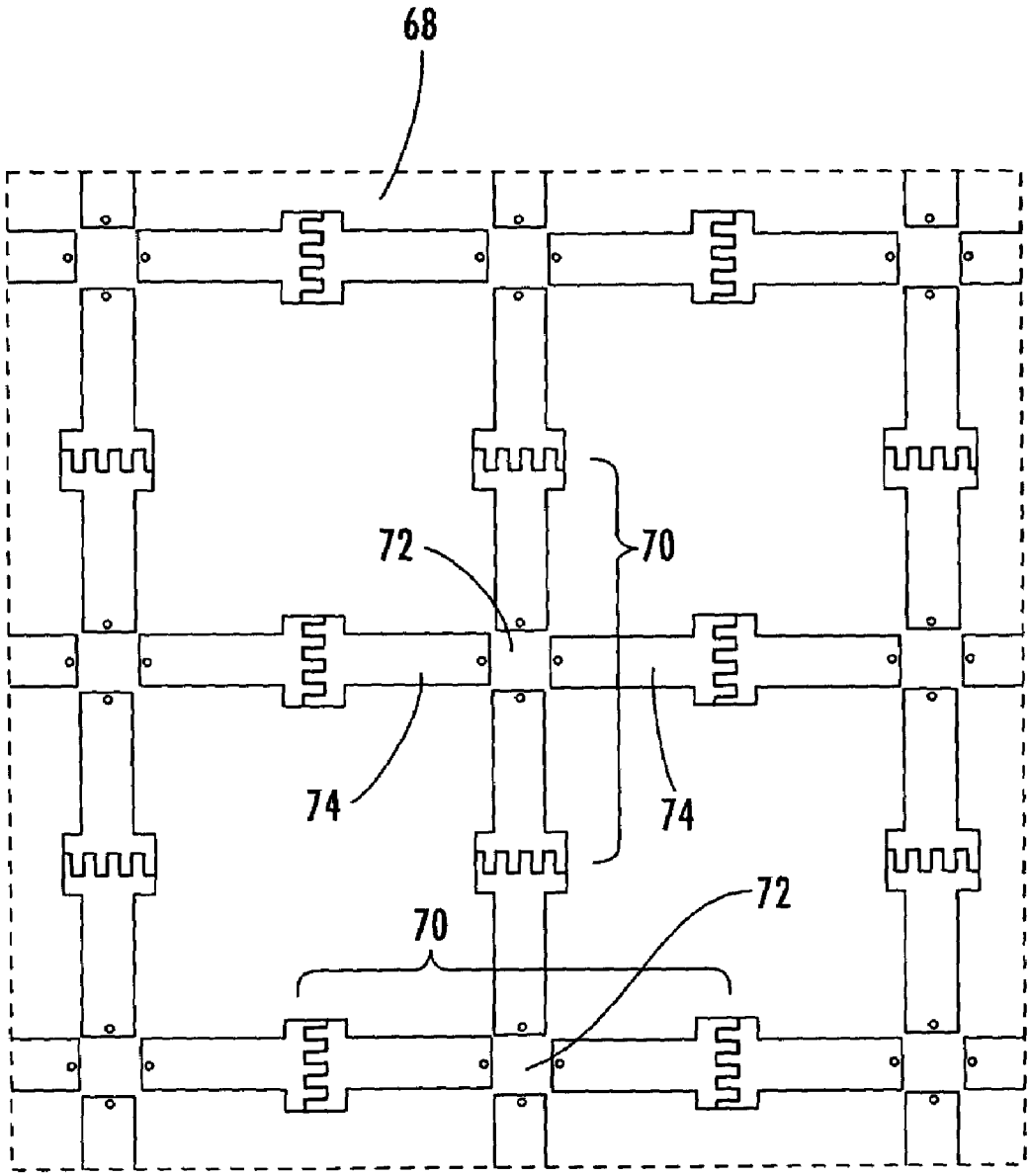
FIG. 7 is an enlarged schematic view of a portion of the array of dipole antenna elements as used in the phased array antenna of FIG. 1.
Figure 8:
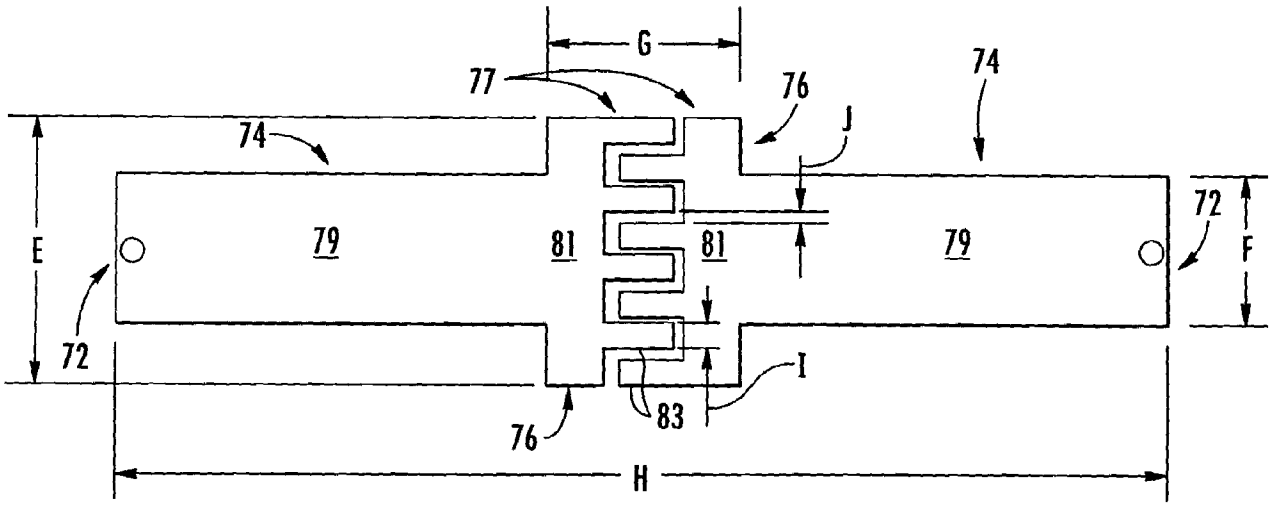
FIG. 8 is an enlarged schematic view of the spaced apart end portions of adjacent legs of adjacent dipole antenna elements as shown in FIG. 7.

Referring now to FIGS. 7 and 8, the array of dipole antenna elements 70 on the dipole layer 20 will now be discussed in greater detail. The illustrated array of dipole antenna elements 70 comprises first and second sets of orthogonal dipole antenna elements to provide dual polarization. Alternately, the impedance matching layer 24 is also advantageous when only one set of dipole antenna elements 70 are used to provide single polarization.

The dipole layer 20 includes a substrate 68 which may have a printed conductive layer thereon defining the array of dipole antenna elements 70. Each dipole antenna element 70 comprises a medial feed portion 72 and a pair of legs 74 extending outwardly therefrom. Respective feed lines would be connected to each feed portion 72 from the opposite side of the substrate 68.

Adjacent legs 74 of adjacent dipole antenna elements 70 have respective spaced apart end portions 76 to provide impedance coupling (i.e., capacitive coupling) between the adjacent dipole antenna elements. The adjacent dipole antenna elements 70 have predetermined shapes and relative positioning to provide capacitive coupling. For example, the capacitance between adjacent dipole antenna elements 70 is between about 0.016 and 0.636 picofarads (pF). Of course, these values will vary as required depending on the actual application to achieve the same desired bandwidth, as readily understood by one skilled in the art.

As shown in FIG. 8, the spaced apart end portions 76 in adjacent legs 74 may have interdigitated portions 77, and each leg 74 comprises an elongated body portion 79, an enlarged width end portion 81 connected to an end of the elongated body portion, and a plurality of fingers 83, e.g., four, extending outwardly from the enlarged width end portion.

The adjacent legs 74 and respective spaced apart end portions 76 may have the following dimensions: the length E of the enlarged width end portion 81 equals 0.061 inches; the width F of the elongated body portions 79 equals 0.034 inches; the combined width G of adjacent enlarged width end portions 81 equals 0.044 inches; the combined length H of the adjacent legs 74 equals 0.276 inches; the width I of each of the plurality of fingers 83 equals 0.005 inches; and the spacing J between adjacent fingers 83 equals 0.003 inches.

The phased array antenna 10 may have a desired frequency range, e.g., 2 GHz to 18 GHz, and the spacing between the end portions 76 of adjacent legs 74 is less than about one-half a wavelength of a highest desired frequency. Depending on the actual application, the desired frequency may be a portion of this range.

Figure 9:
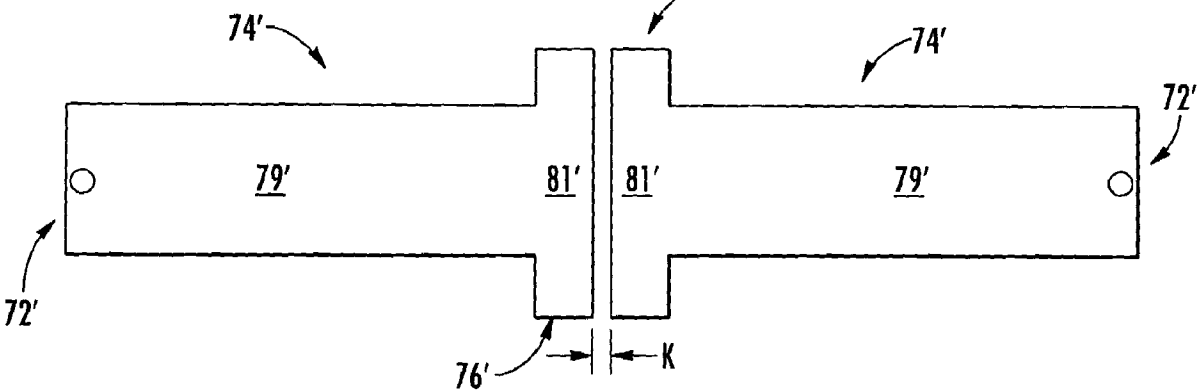
FIG. 9 is an enlarged schematic view of another embodiment of the spaced apart end portions of adjacent legs of adjacent dipole antenna elements as may be used in the phased array antenna of FIG. 1.

Alternately, as shown in FIG. 9, adjacent legs 74' of adjacent dipole antenna elements 70 may have respective spaced apart end portions 76' to provide capacitive coupling between the adjacent dipole antenna elements. In this embodiment, the spaced apart end portions 76' in adjacent legs 74' comprise enlarged width end portions 81' connected to an end of the elongated body portion 79' to provide capacitive coupling between adjacent dipole antenna elements 70. Here, for example, the distance K between the spaced apart end portions 76' is about 0.003 inches.

Figure 10:
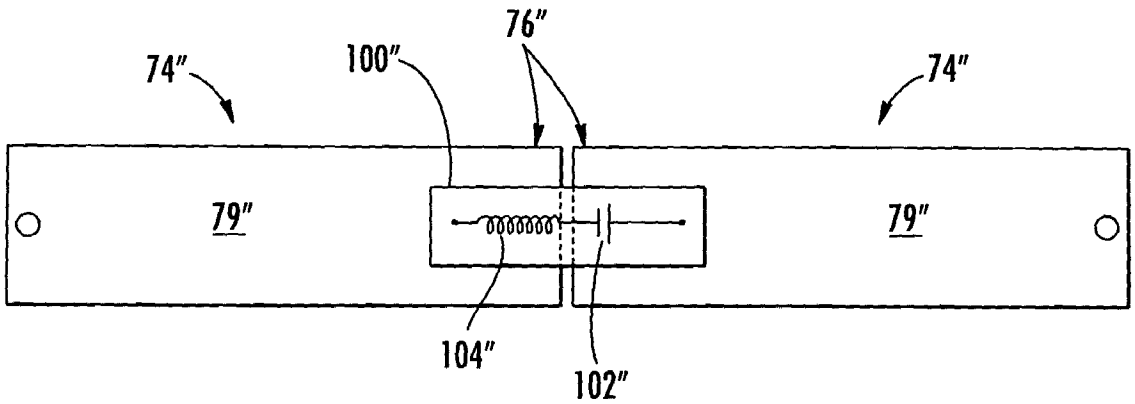
FIG. 10 is an enlarged schematic view of an impedance element associated with the spaced apart end portions of adjacent legs of adjacent dipole antenna elements as may be used in the phased array antenna of FIG. 1.

To supply or increase further the capacitive coupling between adjacent dipole antenna elements 70, a respective discrete or bulk impedance element 100" is electrically connected across the spaced apart end portions 76" of adjacent legs 74" of adjacent dipole antenna elements, as illustrated in FIG. 10.

In the illustrated embodiment, the spaced apart end portions 76" have the same width as the elongated body portions 79". The discrete impedance elements 100" are preferably soldered in place after the dipole antenna elements 70 have been formed so that they overlay the respective adjacent legs 74" of adjacent dipole antenna elements 70. This advantageously allows the same capacitance to be provided in a smaller area, which helps to lower the operating frequency of the phased array antenna 10.

The illustrated discrete impedance element 100" includes a capacitor 102" and an inductor 104" connected together in series. However, other configurations of the capacitor 102" and inductor 104" are possible, as would be readily appreciated by those skilled in the art. For example, the capacitor 102" and inductor 104" may be connected together in parallel, or the discrete impedance element 100" may include the capacitor without the inductor or the inductor without the capacitor. Depending on the intended application, the discrete impedance element 100" may even include a resistor.

The discrete impedance element 100" may also be connected between the adjacent legs 74 with the interdigitated portions 77 illustrated in FIGS. 7 and 8. In this configuration, the discrete impedance element 100" advantageously provides a lower cross polarization in the antenna patterns by eliminating asymmetric currents which flow in the interdigitated capacitor portions 77. Likewise, the discrete impedance element 100" may also be connected between the adjacent legs 74' with the enlarged width end portions 81' illustrated in FIG. 9.

Another advantage of the respective discrete impedance elements 100" is that they may have different impedance values so that the bandwidth of the phased array antenna 10 can be tuned for different applications, as would be readily appreciated by those skilled in the art. In addition, the impedance is not dependent on the impedance properties of the adjacent dielectric layers 26, 28. Since the discrete impedance elements 100" are not affected by the dielectric layers 26, 28, this approach advantageously allows the impedance between the dielectric layers 26, 28 and the impedance of the discrete impedance element 100" to be decoupled from one another.

Figure 11:
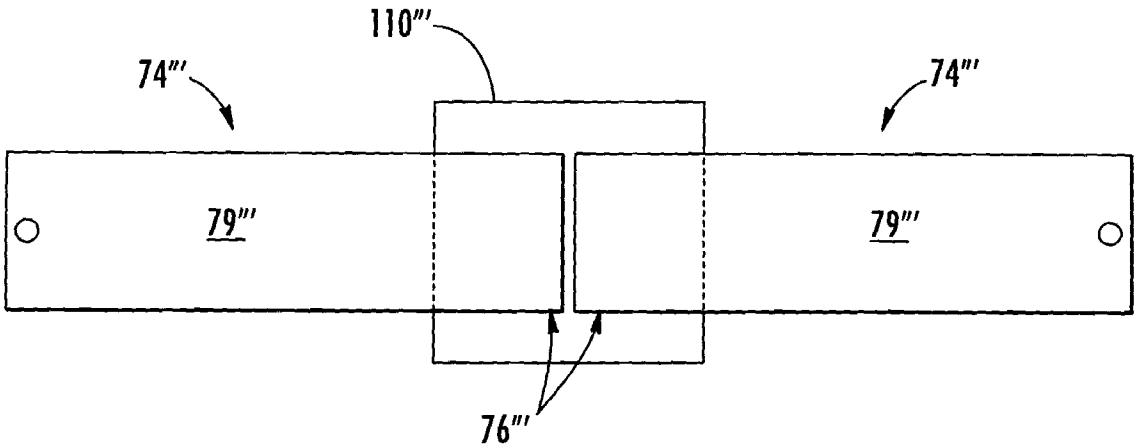
FIG. 11 is an enlarged schematic view of another embodiment of an impedance element associated with the spaced apart end portions of adjacent legs of adjacent dipole antenna elements as may be used in the phased array antenna of FIG. 1.

Yet another approach to further increase the capacitive coupling between adjacent dipole antenna elements 70 includes placing a respective printed impedance element 110''' adjacent the spaced apart end portions 76''' of adjacent legs 74''' of adjacent dipole antenna elements 70, as illustrated in FIG. 11.

The respective printed impedance elements 100''' are separated from the adjacent legs 74''' by a dielectric layer, and are preferably formed before the dipole antenna layer 20 is formed so that they underlie the adjacent legs 74''' of the adjacent dipole antenna elements 70. Alternatively, the respective printed impedance elements 110''' may be formed after the dipole antenna layer 20 has been formed.

Another aspect of the present invention is directed to a method for making an antenna 10 comprising forming an array of dipole antenna elements 70 on a substrate 68, with each dipole antenna element comprising a medial feed portion 72 and a pair of legs 74 extending outwardly therefrom. Adjacent legs 74 of adjacent dipole antenna elements 70 include respective spaced apart end portions 76 with impedance coupling therebetween. The method further comprises positioning at least one impedance matching layer 24 adjacent a side of the array of dipole antenna elements 70 opposite the substrate 68. The at least one impedance matching layer 24 comprises an array of spaced apart conductive elements 31.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna comprising:

a substrate;

an array of dipole antenna elements on said substrate, each dipole antenna element comprising a medial feed portion and a pair of legs extending outwardly therefrom, adjacent legs of adjacent dipole antenna elements including respective spaced apart end portions with impedance coupling therebetween; and at least one impedance matching layer adjacent a side of said array of dipole antenna elements opposite said substrate, said at least one impedance matching layer comprising an array of spaced apart conductive elements.

2. An antenna according to claim 1 wherein said conductive elements are periodically spaced apart from one another.

3. An antenna according to claim 1 wherein each conductive element comprises a conductive loop.

4. An antenna according to claim 3 wherein each conductive loop has a hexagonal shape.

5. An antenna according to claim 1 wherein said at least one impedance matching layer comprises a dielectric layer supporting said array of spaced apart conductive elements.

6. An antenna according to claim 1 wherein said at least one impedance matching layer comprises a plurality of impedance matching layers.

7. An antenna according to claim 1 wherein each leg comprises:

an elongated body portion; and an enlarged width end portion connected to an end of the elongated body portion.

8. An antenna according to claim 1 wherein the spaced apart end portions in adjacent legs comprise interdigitated portions.

9. An antenna according to claim 1 further comprising a respective impedance element associated with the spaced apart end portions of adjacent legs of adjacent dipole antenna elements.

10. An antenna according to claim 1 wherein the antenna has a desired frequency range; and wherein the spacing between the end portions of adjacent legs is less than about one-half a wavelength of a highest desired frequency.

11. An antenna according to claim 1 wherein said array of dipole antenna elements comprises first and second sets of orthogonal dipole antenna elements to provide dual polarization.

12. An antenna according to claim 1 further comprising a ground plane adjacent a side of said substrate opposite said array of dipole antenna elements.

13. An antenna according to claim 12 wherein the antenna has a desired frequency range; and wherein said ground plane is spaced from said array of dipole antenna elements less than about one-half a wavelength of a highest desired frequency.

14. An antenna according to claim 1 wherein said array of dipole antenna elements are sized and relatively positioned so that the antenna is operable over a frequency range of about 2 to 18 GHz.

15. An antenna according to claim 1 wherein each dipole antenna element comprises a printed conductive layer.

16. A phased array antenna comprising:

a substrate;

an array of dipole antenna elements on said substrate, each dipole antenna element comprising a medial feed portion and a pair of legs extending outwardly therefrom, adjacent legs of adjacent dipole antenna elements including respective spaced apart end portions with capacitive coupling therebetween;

at least one impedance matching layer adjacent a side of said array of dipole antenna elements opposite said substrate, said at least one impedance matching layer comprising an array of spaced apart conductive loops; and a controller connected to said array of dipole antenna elements.

17. A phased array antenna according to claim 16 wherein said conductive loops are periodically spaced apart from one another.

18. A phased array antenna according to claim 16 wherein each conductive loop has a hexagonal shape.

19. A phased array antenna according to claim 16 wherein said at least one impedance matching layer comprises a dielectric layer supporting said array of spaced apart conductive elements.

20. A phased array antenna according to claim 16 wherein said at least one impedance matching layer comprises a plurality of impedance matching layers.

21. A phased array antenna according to claim 16 wherein each leg comprises:

an elongated body portion; and an enlarged width end portion connected to an end of the elongated body portion.

22. A phased array antenna according to claim 16 wherein the spaced apart end portions in adjacent legs comprise interdigitated portions.

23. A phased array antenna according to claim 16 further comprising a respective impedance element associated with the spaced apart end portions of adjacent legs of adjacent dipole antenna elements.

24. A phased array antenna according to claim 16 wherein the phased array antenna has a desired frequency range; and wherein the spacing between the end portions of adjacent legs is less than about one-half a wavelength of a highest desired frequency.

25. A phased array antenna according to claim 16 wherein said array of dipole antenna elements comprises first and second sets of orthogonal dipole antenna elements to provide dual polarization.

26. A phased array antenna according to claim 16 further comprising a ground plane adjacent a side of said substrate opposite said array of dipole antenna elements.

27. A phased array antenna according to claim 26 wherein the phased array antenna has a desired frequency range; and wherein said ground plane is spaced from said array of dipole antenna elements less than about one-half a wavelength of a highest desired frequency.

28. A phased array antenna according to claim 16 wherein said array of dipole antenna elements are sized and relatively positioned so that the phased array antenna is operable over a frequency range of about 2 to 18 GHz.

29. A method for making an antenna comprising:

forming an array of dipole antenna elements on a substrate, each dipole antenna element comprising a medial feed portion and a pair of legs extending outwardly therefrom, and adjacent legs of adjacent dipole antenna elements including respective spaced apart end portions with impedance coupling therebetween; and positioning at least one impedance matching layer adjacent a side of the array of dipole antenna elements opposite the substrate, the at least one impedance matching layer comprising an array of spaced apart conductive elements.

30. A method according to claim 29 wherein the conductive elements are periodically spaced apart from one another.

31. A method according to claim 29 wherein each conductive element comprises a conductive loop.

32. A method according to claim 31 wherein each conductive loop has a hexagonal shape.

33. A method according to claim 29 further comprising forming a dielectric layer supporting the array of spaced apart conductive elements.

34. A method according to claim 29 wherein the at least one impedance matching layer comprises a plurality of impedance matching layers.

35. A method according to claim 29 wherein each leg comprises an elongated body portion, and an enlarged width end portion connected to an end of the elongated body portion.

36. A method according to claim 29 wherein the spaced apart end portions in adjacent legs comprise interdigitated portions.

37. A method according to claim 29 further comprising associating a respective impedance element with the spaced apart end portions of adjacent legs of adjacent dipole antenna elements.

38. A method according to claim 29 wherein the antenna has a desired frequency range; and wherein the spacing between the end portions of adjacent legs is less than about one-half a wavelength of a highest desired frequency.

39. A method according to claim 29 wherein the array of dipole antenna elements comprises first and second sets of orthogonal dipole antenna elements to provide dual polarization.

40. A method according to claim 29 further comprising positioning a ground plane adjacent a side of the substrate opposite the array of dipole antenna elements.

41. A method according to claim 40 wherein the antenna has a desired frequency range; and wherein the ground plane is spaced from the array of dipole antenna elements less than about one-half a wavelength of a highest desired frequency.

42. A method according to claim 29 wherein the array of dipole antenna elements are sized and relatively positioned so that the antenna is operable over a frequency range of about 2 to 18 GHz.

* * * * *